United States Patent [19]

Crommentuyn et al.

[11] 3,935,009

[45] Jan. 27, 1976

[54] ELECTROPHOTOGRAPHIC REPRODUCTION ELEMENT OF AN ANILINE COMPOUND ELECTRON ACCEPTOR

[75] Inventors: Gerardus J. Crommentuyn, Lottum; Johannes H. A. Kuiper, Grubbenvorst, both of Netherlands

[73] Assignee: Océ-van der Grinten N.V., Venlo, Netherlands

[22] Filed: Feb. 6, 1974

[21] Appl. No.: 440,245

[30] Foreign Application Priority Data

Feb. 14, 1973 Netherlands ..... 7302034

[52] U.S. Cl. ..... 96/1.5; 96/1.6; 260/566 R; 260/397.6

[51] Int. Cl.[2] ..... G03G 5/04

[58] Field of Search ..... 96/1, 1.5, 1.6; 260/566 R, 260/397.6

[56] References Cited

UNITED STATES PATENTS 3,037,861 6/1962 Hoegl ..... 96/1.5

3,617,271 11/1971 Poot ..... 96/1.6

*Primary Examiner*—Norman G. Torchin
*Assistant Examiner*—John L. Goodrow
*Attorney, Agent, or Firm*—Albert C. Johnston

[57] ABSTRACT

Reproduction elements coated with organic photoconductors are made with improved and/or more widely selectable electrophotographic properties by employing in the photoconductive coating a donor-acceptor complex composed of a known organic electron donor having photo- or semiconductor properties, e.g. a poly-N-vinylcarbazole or polyvinylpyrene, and a N-(fluoren-9-ylidene)-aniline compound as an activating electron acceptor. Especially effective as the electron acceptor are certain new compounds, namely, p- and m-nitro-N-(2,4,7-trinitrofluoren-9-ylidene)-aniline and p-methylsulfonyl-N-(2,4,7-trinitrofluoren-9-ylidene)-aniline.

16 Claims, No Drawings

ELECTROPHOTOGRAPHIC REPRODUCTION ELEMENT OF AN ANILINE COMPOUND ELECTRON ACCEPTOR

This invention relates to an electrophotographic reproduction element of the type comprising a suitable support having on it a photoconductive coating layer which contains a donor-acceptor complex formed of an electron donor having photo- or semiconductor properties and an electron acceptor.

A reproduction element of that type is known, for example, from German Auslegeschrift No. 1,111,935 which describes a reproduction element having a photoconductive layer formed of a polymer of N-vinylcarbazole containing one or more activators, with or without optical sensitizers. All the activators mentioned in that publication are compounds having a high electron affinity, called electron acceptors. Such electron acceptors, which may be considered as Lewis acids, are capable of forming donor-acceptor complexes, also called pi-complexes or charge transfer complexes (ct-complexes), with compounds which easily release electrons and are called electron donors.

While German Auslegeschrift No. 1,111,935 mentions only poly-N-vinylcarbazole as a photoconductive electron donor, in German Auslegeschrift No. 1,127,218 a whole series of photoconductive electron donors is enumerated which can be activated by electron acceptors when the amount of acceptor added is from about 0.1 to about 100 moles per 1,000 moles of donor. German Auslegeschrift No. 1,219,795, an addition to German Auslegeschrift No. 1,127,218, further indicates that the amount of acceptor can be much greater: 10 to 10,000 moles per mole of donor.

Originally almost all Lewis acids were considered to be suitable for use as an activating acceptor, but soon a preference for the fluorenone compounds was developing. Also from the numerous organic compounds which had photoconductive properties, already soon one compound rose forward as being extremely suitable, namely, poly-N-vinylcarbazole (PVK).

Particularly in combination with PVK the fluorenone-compounds, and especially 2,4,7-trinitrofluorenone (TNF), yield highly light-sensitive layers. In this respect reference can be made to the Dutch application No. 67,07,950, as well as to the article of R. M. Schaffert in I.B.M. Journ. Res. Develop. 15 75 (January 1971).

Hard attempts have been made to extend the number of classes of compounds which might be suitable as activating acceptors to the same extent as TNF.

Thus the class of the 9-dicyanomethylenefluorene-compounds or the 9-fluorenylidenemalono-dinitrile-compounds is known from the Dutch applications Nos. 6,809,655, 6,814,856 and 7,013,324. The mechanism by which this sensitivity-increase is caused — whether the compound has a sensitizing effect or the complex formed is photoconductive or has a sensitizing and/or activating effect — is not known. Therefore the sensitivity-increasing compound which on account of its electron-accepting properties is capable of forming a pi-complex with photoconductive electron-donors, will henceforth be indicated neutrally with acceptor.

After all, practically speaking only two classes are known of pi-complex forming compounds which can be considered as acceptor for poly-N-vinylcarbazole — which up to now has been the most attractive and the most applied photoconductor — namely the above-mentioned fluorene- and fluorenone compounds. Out of both classes the compounds which are the most suitable and practically applicable, are the 2,4,7-trinitroderivatives. It will be clear without more, that with such a limited assortment it is difficult to develop a reproduction-element, based on organic photoconductors, which in all facets will function to the best degree.

The invention not only enlarges the assortment of acceptors for organic photoconductive donors, especially poly-N-vinyl-carbazole, but also improves the availability of better acceptors for that purpose.

Thus the object of the invention is to provide an electrophotographic reproduction-element which in practice gives at least as much satisfaction as the known elements.

This is achieved by selecting an electophotographic reproduction-element which comprises a suitable support with a photoconductive coating-layer on it which layer contains a donor-acceptor complex, which is built up of an electron-donor with photo- or semiconductor properties, and of an electron-acceptor, characterized in that the acceptor is a compound of the formula I:

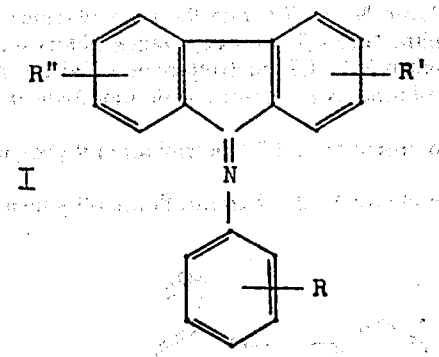

I in which R stands for one or more electron-attracting compounds known by themselves and/or for a lower alkyl or alkoxy group or for a hydrogen atom, while each of the symbols R′ and R″ which may be the same or different, represents a hydrogen atom or one or more electron-attracting groups known by themselves, on the understanding that at least one of the symbols R′ and R″ does not represent a hydrogen atom. Electron-attracting groups known by themselves are for instance: a halogen atom, a nitro, cyano, acid, ester, alkylsulfinyl, alkylsulfonyl and a trifluoromethyl group, whereby an acid group — and therefore also an ester group — may be both a carboxylic acid group or a sulfonic acid group.

A lower alkyl group relates in this case to an alkyl group in which the number of carbon atoms can vary from 1 to 6, and in which if so required one or more hydrogen atoms may have been replaced by electron-attracting groups. The same also relates to the alkyl residue in the alkoxy group.

Groups as: $CH_3$, $CHCl_2$, $CCl_3$, $OCH_3$, $OCF_3$ and such like can be taken into consideration.

Preferably a compound is used in which the symbol R stands for one or more electron-attracting groups, known by themselves, and/or for a methoxy group or hydrogen atom, while each of the symbols R′ and R″, which may be the same or different, represents a hydrogen atom or one or more nitro groups, but whereby again at least one of the symbols R′ and R″ does not represent a hydrogen atom. The symbol R stands specially for one or more of the electron-attracting substituents nitro, halogen, trifluoromethyl and methylsulfonyl, or for a hydrogen atom.

It has appeared that, in relation to the nitrogen atom which forms the link between the fluorene- and the benzene-residue, R must preferably take up the para- or meta-position.

Examples of acceptors suitable according to the invention are:

1. N-(2-nitrofluoren-9-ylidene)-aniline
2. N-(2,5-dinitrofluoren-9-ylidene)-aniline
3. N-(2,7-dinitrofluoren-9-ylidene)-aniline
4. N-(2,4,7-trinitrofluoren-9-ylidene)-aniline
5. N-(2,4,5,7-tetranitrofluoren-9-ylidene-aniline
6. p-fluoro-N-(2-nitrofluoren-9-ylidene)-aniline
7. p-chloro-N-(2-nitrofluoren-9-ylidene)-aniline
8. p-fluoro-N-(2,5-dinitrofluoren-9-ylidene)-aniline
9. p-fluoro-N-(2,7-dinitrofluoren-9-ylidene)-aniline
10. p-chloro-N-(2,5-dinitrofluoren-9-ylidene)-aniline
11. p-chloro-N-(2,7-dinitrofluoren-9-ylidene)-aniline
12. p-nitro-N-(2,7-dinitrofluoren-9-ylidene)-aniline
13. p-fluoro-N-(2,4,7-trinitrofluoren-9-ylidene)-aniline
14. p-nitro-N-(2,4,7-trinitrofluoren-9-ylidene)-aniline
15. m-nitro-N-(2,4,7-trinitrofluoren-9-ylidene)-aniline
16. p-bromo-N-(2,4,7-trinitrofluoren-9-ylidene)-aniline
17. o-bromo-N-(2,4,7-trinitrofluoren-9-ylidene)-aniline
18. p-chloro-N-(2,4,7-trinitrofluoren-9-ylidene)-aniline 19. m-chloro-N-(2,4,7-trinitrofluoren-9-ylidene)-aniline
20. p-trifluoromethyl-N-(2,4,7-trinitrofluoren-9-ylidene)-aniline
21. p-methylsulfonyl-N-(2,4,7-trinitrofluoren-9-ylidene)-aniline
22. p-methoxy-N-(2,4,7-trinitrofluoren-9-ylidene)-aniline
23. 3,4-dichloro-N-(2,4,7-trinitrofluoren-9-ylidene)-aniline
24. 2,5-dichloro-N-(2,4,7-trinitrofluoren-9-ylidene)-aniline
25. 2-chloro-5-methoxy-N-(2,4,7-trinitrofluoren-9-ylidene)-aniline
26. 4-chloro-3-nitro-N-(2,4,7-trinitrofluoren-9-ylidene)-aniline
27. 4-chloro-2-methyl-N-(2,4,7-trinitrofluoren-9-ylidene)-aniline
28. p-nitro-N-(2,4,5,7-tetranitrofluoren-9-ylidene)-aniline It is supposed that the complex-formation and therefore also the sensitivity-increasing effect of the N-(fluoren-9-ylidene)-aniline compounds depends on the electron-attracting effect of the substituents carried by the compounds.

The strongly electron-attracting nitro groups are preferred as substituents.

As acceptor according to the invention preferably p- or m- nitro-N-(2,4,7-trinitrofluoren-9-ylidene)-aniline or p-methyl-sulfonyl-N-(2,4,7-trinitrofluoren-9-ylidene)-aniline of the formula II respectively III respectively IV as shown below are used:

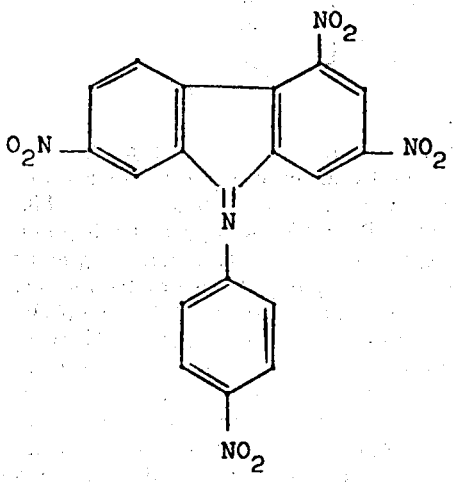

II

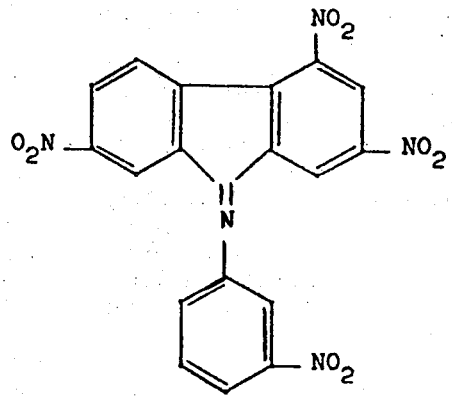

III

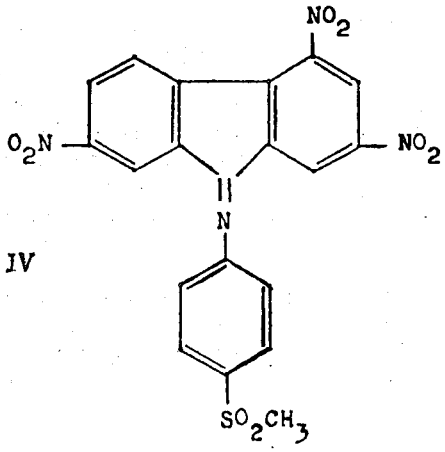

IV

In principle the acceptors according to the invention can be applied with each electron-releasing photoconductor with which a donor-acceptor complex can be formed.

Especially with poly-N-vinylcarbazole or polyvinylpyrene, substituted or non-substituted, a very active complex is formed. But also with other photoconductors such as N-ethylcarbazole, 2,5-bis-(4-aminophenyl)-1,3,4-oxadiazole and 2,5-bis(4-dialkylaminophenyl)-1,3,4-oxadiazole or poly-9-vinylanthracene, substituted or non-substituted, light-sensitive donor-acceptor complexes are formed.

The invention adds a new class of acceptors, being very suitable for the electrophotographic copying process, to the two classes already known. Especially in combination with poly-N-vinylcarbazole or polyvinylpyrene, halogenated or non-halogenated, the compounds of this new class of acceptors yield an electrophotographic reproduction-element which, with regard to all properties which are important for a reproduction-element, such as discharge-speed in dark and light, memory-effect and contrast-reproduction, can excellently stand a comparison with the best reproduction-elements known so far based on organic photoconductors.

In proportion to the amount of photoconductor the amount of acceptor added can vary within very wide limits. The lower limit is determined by that amount which still exercises an activating effect on the photoconductor. This lower limit appears to lie near the limit, already mentioned in earlier literature, of 0.001 mole per 1 mole of photoconductor, which with regard to polymers is calculated to the monomeric unit. The upper limit is determined by the solubility of the acceptor in the solvent. For the combination of PVK or polyvinylpyrene with one of the preferential compounds, such as p- or m-nitro-N-(2,4,7-trinitrofluoren-9-ylidene)-aniline, or p-methylsulfonyl-N-(2,4,7-trinitrofluoren-9-ylidene)-aniline, this upper limit lies for instance near the mole-proportion 1:1.

The amounts of acceptor preferably lie in the range between the 0.02 and 1 mole per mole of photoconductor, calculated to the monomeric unit.

The reproduction-elements according to the invention are obtained by coating a suitable support with a photoconductive composition which contains a donor-acceptor complex according to the invention. The support may consist of i.a. a metal plate or foil, a plastic foil, on which a conductive layer has been applied, or of paper which is either sufficiently conductive from origin, for instance by impregnation in the paper-mill with conductive materials, or which is made conductive by providing it with a conductive layer, for instance a layer containing carbon.

It stands to reason, that in addition to the electron-donor and the electron-acceptor according to the invention the light-sensitive layer may contain one or more photoconductors and/or one or more lightsensitivity-increasing compounds.

When the electron-donor itself does not possess any filmforming properties, a binder can be added for that purpose. The thickness of the photoconductive layers is not critical and can vary within fairly spacious limits. In general a thickness of 3–10 $\mu$ is already sufficient to give practically usable layers, but also thicker layers, for instance of 20 $\mu$, are suitable.

The reproduction-elements according to the invention can be used both in the direct and in the indirect electrophotographic copying process. With the direct electrophotographic process the latent image formed on the reproduction-element is developed and fixed. With the indirect process the latent image is either first transferred to a receiving material, such as paper, and developed and fixed on it, or is first developed, after which the loose powder-image is transferred to a receiving-material and fixed on it. The reproduction-elements can be positively and negatively charged.

The invention further relates to a process for preparing a composition which is suitable for the manufacture of a reproduction-element according to the invention, whereby a mixture is prepared of an organic electron-donor compound with photo- or semiconductor properties and of an organic electron-acceptor compound, by which a donor-acceptor complex is formed.

This process is characterized in that as acceptor a compound of formula I shown hereinabove is selected, in which R stands for one or more electron-attracting groups, known by themselves, and/or for a lower alkyl or alkoxy group, or for a hydrogen atom, while each of the symbols R′ and R″, which may be the same or different, represents a hydrogen atom or one or more electron-attracting groups known by themselves, with the understanding that at least one of the symbols R′ and R″ does not represent a hydrogen atom.

Although some of the fluoren-9-ylidene-anilines now proposed were already compounds known by themselves, it was not known that they tend to accept electrons from other compounds, by which they are capable of forming donor-acceptor complexes with these compounds. Therefore their application as complex-forming acceptor in the electrophotographic coyping process is new and not obvious.

The compounds of formula I shown hereinabove, in which each of the symbols R′ and R″, which may be the same or different, represents a hydrogen atom or one or more nitro groups and whereby R stands for a nitro group, a trifluoromethyl or for a methylsulfonyl group, are new. To these belong also the preferential compounds m- and p-nitro-N-(2,4,7-trinitrofluoren-9-ylidene)-aniline and p-methyl-sulfonyl-N-(2,4,7-trinitrofluoren-9-ylidene)-aniline.

For the preparation of the acceptors reference can be made to the articles of Taylor and Fletcher in J. Org. Chem. 21, 523-527 (1956), J. Am. Chem. Soc. 80, 2246-2249 (1958) and J. Org. Chem. 26, 940-942 (1961).

Also the above-mentioned new compounds can be prepared in an analogous way.

The invention further relates to an image-support which is characterized in that the image is made on a reproduction-element according to the invention.

The following examples serve to illustrate the invention.

EXAMPLES

With the examples 1–8 the mole-proportion donor:acceptor was about 20:1, with the examples 9–12 about 2:1.

EXAMPLE 1.

To a solution of 1.5 g of PVK in 10 ml of monochlorobenzene a solution of 0.169 g of m-nitro-N-(2,4,7-trinitrofluoren-9-ylidene)-aniline in 10 ml of 1,4-dioxane was added. The two solutions were added in warm condition to each other and were stirred for some time at a temperature of 60°C. After the solution had been cooled down again to room temperature, an aluminium support was coated by means of this composition with a lightsensitive layer of 2-3 $\mu$ thickness, by which an electrophotographic reproduction-element was obtained. By means of a corona charging device this element was charged to a negative potential of 300 V. Upon exposure with a glowlamp the amount of luxsec required to reduce the potential to 10% of the original value, was 170.

The positive charging was 210 V. The 10%-sensitivity now was 200 luxsec.

For a corresponding layer consisting of PVK + TNF the 10%-sensitivity was 185 luxsec for a layer charged negatively and 190 luxsec for a layer charged positively.

EXAMPLES 2–8.

Seven solutions were prepared of 1.5 g of PVK in 10 ml of monochlorobenzene. By adding one of the following acceptors:

1) 0.151 g of N-(2,4,7-trinitrofluoren-9-ylidene)-aniline
2) 0.169 g of p-nitro-N-(2,4,7-trinitrofluoren-9-ylidene)-aniline
3) 0.183 g of p-bromo-N-(2,4,7-trinitrofluoren-9-ylidene)-aniline
4) 0.178 g of p-($\alpha$,$\alpha$,$\alpha$-trifluoromethyl)-N-(2,4,7-trinitrofluoren-9-ylidene)-aniline
5) 0.182 g of 4-chloro -3-nitro-N-(2,4,7-trinitrofluoren-9-ylidene)-aniline
6) 0.178 g of 3,4-dichloro-N-(2,4,7-trinitrofluoren-9-ylidene)-aniline
7) 0.204 g of p-nitro-N-(2,4,5,7-tetranitrofluoren-9-ylidene)-aniline.½ dioxane each dissolved in 10 ml of 1,4-dioxane, seven different compositions were prepared, by means of which seven electrophotographic reproduction-elements were obtained in a similar way as mentioned under example 1.

Upon exposure with a glow-lamp the 10%-sensitivity for the various elements subsequently was:

| | with positive charging | with negative charging |
|---|---|---|
| 1) | 500 luxsec | 475 luxsec |
| 2) | 190 luxsec | 170 luxsec |
| 3) | 455 luxsec | 340 luxsec |
| 4) | 215 luxsec | 300 luxsec |
| 5) | 185 luxsec | 215 luxsec |
| 6) | 285 luxsec | 285 luxsec |
| 7) | 185 luxsec | 195 luxsec |

EXAMPLE 9.

1.02 g of p-nitro-N-(2,4,7-trinitrofluoren-9-ylidene)-aniline was solved in 12 ml of 1,4-dioxane, whilst heating to about 60°C. This solution was added to a solution of 0.9 g of PVK in 11 ml of tetrahydrofurane. After the whole was cooled down to about 20°C, an aluminium support was coated with a light-sensitive layer of 2–3 $\mu$ thick with the aid of the composition thus obtained. In this way an electrophotographic reproduction-element was obtained. By means of a corona charging device this element was charged to a positive potential of 200 V. Upon exposure with a glow-lamp the number of luxsec required to reduce the potential to 10% of the original value, was 47. The negative charging which could be given to the layer, was 420 V. The 10%-sensitivity now amounted to 45 luxsec.

By way of comparison two reproduction-elements were manufactured by coating an aluminium support with a layer of PVK + TNF of 2–3 $\mu$ thickness in a mole-proportion of subsequently 2:1 and 1:1.

The 10%-sensitivities for both elements amounted to respectively:

| | with positive charging | with negative charging |
|---|---|---|
| PVK+TNF (2 : 1) | 83 luxsec | 72 luxsec |
| PVK+TNF (1 : 1) | 47 luxsec | 47 luxsec |

From this it appears, that a reproduction-element according to the invention, which contains a photoconductive layer consisting of PVK and p-nitro-N-(2,4,7-trinitrofluoren-9-ylidene)-aniline in a mole-proportion of 2:1, is as sensitive as the most rapid reproduction-element, known so far and based on an organic photoconductor, namely one which bears a photoconductive layer of PVK and TNF in the mole-proportion 1:1. This means that the acceptor according to the invention is more active than TNF.

EXAMPLE 10.

When the acceptor used in the preceding example was replaced by m-nitro-N-(2,4,7-trinitrofluoren-9-ylidene)-aniline, the result obtained was:

positive charging to 305 V; 10%-sensitivity 62 luxsec
negative charging to 340 V; 10%-sensitivity 80 luxsec.

EXAMPLE 11–12.

While maintaining the proportion donor:acceptor = 2:1, the acceptor used in the preceding example was replaced by:

1. N-(2,4,7-trinitrofluoren-9-ylidene)-aniline
2. p-($\alpha$, $\alpha$, $\alpha$-trifluoromethyl)-N-(2,4,7-trinitrofluoren-9-ylidene)-aniline.

The results obtained (charging and 10%-sensitivity) were respectively:

| | with positive charging | with negative charging |
|---|---|---|
| 1) | 285 V ; 175 luxsec | 435 V ; 135 luxsec |
| 2) | 235 V ; 110 luxsec | 320 V ; 125 luxsec |

EXAMPLE 13.

For obtaining a copy a reproduction-element according to the invention, for instance one obtained according to example 9 or 10, was charged by means of a 7 kV corona charging device, which could be both a positive and a negative charging. Subsequently the reproduction-element was image-wise exposed in an enlargement-apparatus for about 3½ seconds, whereby the intensity of the incident light on the surface of the element was 30–35 lux. The latent charge-pattern was developed with a powder-developer, the powder-image thus obtained was covered with a sheet of paper (for instance Diapost-paper of Oce-van der Grinten N.V.) and subsequently it was transferred by means of an electric field to the paper. After fixing a nice, sharp image was produced on the paper.

EXAMPLE 14.

To a warm solution of 1.5 g of poly-1-vinylpyrene in 10 ml of monochlorobenzene a warm solution of 0.143 g of p-nitro-N-(2,4,7-trinitrofluoren-9-ylidene)-aniline in 7 ml of 1,4-dioxane was added, after which the mixture was stirred for some time at a temperature of about 60°C.

The proportion donor:acceptor was 20:1.

In the way mentioned in example 1 an electrophotographic reproduction-element was manufactured with this composition and was subsequently tested.

The results were:

negative charging to 260 V; 10%-sensitivity 190 luxsec positive charging to 240 V; 10%-sensitivity 120 luxsec

EXAMPLE 15.

When in the preceding example the proportion donor:acceptor was brought at 5:1, the results obtained were:

negative charging to 345 V; 10%-sensitivity 62 luxsec positive charging to 230 V; 10%-sensitivity 60 luxsec By way of comparison a reproduction-element was manufactured by coating an aluminium support with a layer of PVK + TNF of 2–3 $\mu$ thickness in a mole-proportion of 5:1.

The 10%-sensitivity of this element was 105 luxsec at a negative and 120 luxsec at a positive charging.

This implies, that the sensitivity of this element is almost twice as small as that of the element according to the invention.

EXAMPLE 16.

Polyvinylpyrene was converted by means of a brominating agent such as dioxane dibromide, into brominated polyvinylpyrene in which the proportion of the monomeric unit vinylpyrene to bromine was about 1:1.

0.7 g of the brominated polyvinylpyrene thus obtained was dissolved under heating in 7 ml of o-dichlorobenzene. At about 60°C a solution of 91 mg of p-nitro-N-(2,4,7-trinitrofluoren-9-ylidene)-aniline in 2 ml of tetrahydrofurane was added, so that the mole-proportion donor:acceptor was about 10:1. In a way similar to the way described in example 1 an electro photographic reproduction-element was manufactured by means of this composition and was subsequently tested.

The results were:

positive charging to 170 V; 10%-sensitivity 82 luxsec negative charging to 160 V; 10%-sensitivity 71 luxsec

What is claimed is:

1. An electrophotographic reproduction element comprising a support having on it a photoconductive coating layer which contains a donor-acceptor complex formed of an electron donor having photo- or semiconductor properties and an electron acceptor, wherein the electron acceptor is a compound of the formula

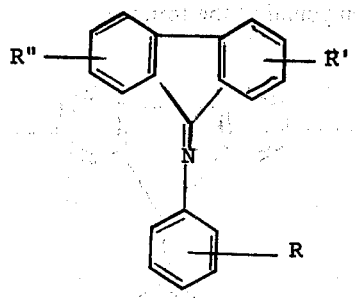

in which R represents one or more moieties selected from the group consisting of hydrogen and halogen atoms and lower alkyl, lower alkoxy, nitro, cyano, carboxylic acid, carboxylic ester, sulfonic acid, sulfonic ester, alkylsulfinyl, alkylsulfonyl and trifluoromethyl substituents and R′ and R″ each represents a hydrogen atom or one or more nitro groups but at least one of R′ and R″ is not a hydrogen atom.

2. An electrophotographic reproduction element according to claim 1, wherein R is a methoxy group.

3. An electrophotographic reproduction element according to claim 1, wherein R is selected from the group consisting of nitro, halogen, trifluoromethyl and methylsulfonyl substituents or is a hydrogen atom.

4. An electrophotographic reproduction element according to claim 1, wherein R is in the para or meta position relative to the nitrogen atom which forms the link between the fluorene and benzene residues.

5. An electrophotographic reproduction element according to claim 1, wherein the electron acceptor is p- or m-nitro-N-(2,4,7-trinitrofluoren-9-ylidene)-aniline or p-methylsulfonyl-N-(2,4,7-trinitrofluoren-9-ylidene)-aniline.

6. A photoconductive composition for use in the coating layer of an electrophotographic reproduction element, comprising in admixture an organic electron donor having photo- or semiconductive properties and an organic electron acceptor that forms a donor-acceptor complex with said donor, said acceptor being a compound of the formula

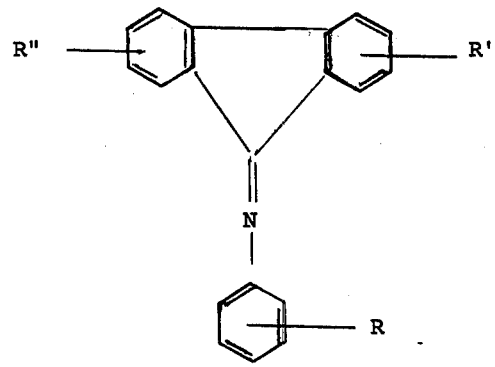

in which R represents one or more moieties selected from the group consisting of hydrogen and halogen atoms and lower alkyl, lower alkoxy, nitro, cyano, carboxylic acid, carboxylic ester, sulfonic acid, sulfonic ester, alkylsulfinyl, alkylsulfonyl and trifluoromethyl substituents and R′ and R″ each represents a hydrogen atom or one or more nitro groups but at least one of R′ and R″ is not a hydrogen atom.

7. A compound of the formula

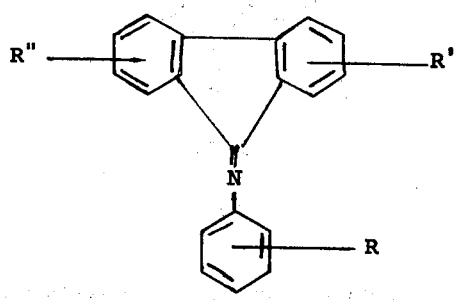

in which R is a nitro, trifluoromethyl or methyl sulfonyl group and R′ and R″ each is a hydrogen atom or one or more nitro groups, but at least one of R′ and R″ is not a hydrogen atom.

8. A compound according to claim 7, selected from the group consisting of p- or m-nitro-N-(2,4,7-trinitrofluoren-9-ylidene)-aniline and p-methylsulfonyl-N-(2,4,7-trinitrofluoren-9-ylidene)-aniline.

9. An electrophotographic reproduction element according to claim 1, carrying an electrophotographic image on the photoconductive coating layer thereof.

10. An electrophotographic reproduction element according to claim 1, said electron donor being a poly-N-vinyl carbazole or a polyvinyl pyrene.

11. An electrophotographic reproduction element according to claim 1, said electron donor being a poly-N-vinyl carbazole or a polyvinyl pyrene and said electron acceptor being p- or m-nitro-N-(2,4,7-trinitrofluoren-9-ylidene)-aniline or p-methylsulfonyl-N-(2,4,7-trinitrofluorene-9-ylidene)-aniline, said acceptor being present in a molar ratio of between 0.02 and 1 to the amount of such donor calculated to the monomeric unit thereof.

12. An electrophotographic reproduction element according to claim 1, said electron donor being a poly-N-vinyl carbazole or a polyvinyl pyrene and said electron acceptor being p-nitro-N-(2,4, 7-trinitrofluorene-9-ylidene)-aniline and being present in a molar ratio of between 0.02 and 1 to the amount of said donor calculated to the monomeric unit thereof.

13. A photoconductive composition according to claim 6, said electron donor being a poly-N-vinyl carbazole or a polyvinyl pyrene.

14. A photoconductive composition according to claim 6, said electron donor being a poly-N-vinyl carbazole or a polyvinyl pyrene and said electron acceptor being p- or m-nitro-N-(2,4,7-trinitrofluorene-9-ylidene)- aniline or p-methylsulfonyl-N-(2,4,7-trinitrofluoren-9-ylidene)-aniline, said acceptor being present in a molar ratio of between 0.02 and 1 to the amount of said donor calculated to the monomeric unit thereof.

15. A photoconductive composition according to claim 6, said electron donor being a poly-N-vinyl carbazole or a polyvinyl pyrene and said electron acceptor being p-nitro-N-(2,4, 7-trinitrofluorene-9-ylidene)-aniline and being present in a molar ratio of between 0.02 and 1 to the amount of said donor calculated to the monomeric unit thereof.

16. A compound according to claim 7, namely, p-nitro-N-(2,4,7-trinitrofluorene-9-ylidene)-aniline.

* * * * *